US005924791A

United States Patent [19]

Arai et al.

[11] Patent Number: 5,924,791

[45] Date of Patent: Jul. 20, 1999

[54] LIGHT SOURCE DEVICE FOR ENDOSCOPE WHICH SHIELDS LAMP NOISE

[75] Inventors: Kaoru Arai; Shigeo Suzuki, both of Omiya, Japan

[73] Assignee: Fuji Photo Optical Co., Ltd., Saitama, Japan

[21] Appl. No.: 08/867,816

[22] Filed: Jun. 3, 1997

[30] Foreign Application Priority Data

Jun. 12, 1996 [JP] Japan ..... 8-172892

[51] Int. Cl.[6] ..... F21V 29/00

[52] U.S. Cl. ..... 362/373; 362/155; 362/264; 362/294; 362/580

[58] Field of Search ..... 362/373, 155, 362/264, 294, 580

[56] References Cited

U.S. PATENT DOCUMENTS

| | | | |
|---|---|---|---|
| 1,966,531 | 7/1934 | Tint | 88/24 |
| 3,457,454 | 7/1969 | Boland | 315/115 |
| 4,234,910 | 11/1980 | Price | 362/105 |
| 4,572,164 | 2/1986 | Yoshida | 128/6 |
| 4,922,385 | 5/1990 | Awai | 362/32 |
| 4,933,816 | 6/1990 | Hug et al. | 362/32 |
| 5,099,399 | 3/1992 | Miller et al. | 362/32 |
| 5,111,367 | 5/1992 | Churchill | 362/32 |
| 5,479,322 | 12/1995 | Kacheria | 362/32 |
| 5,497,573 | 3/1996 | Stadjuhar et al. | 40/564 |
| 5,526,249 | 6/1996 | Karasawa | 362/362 |

*Primary Examiner*—Thomas M. Sember
*Assistant Examiner*—John A. Ward
*Attorney, Agent, or Firm*—Ronald R. Snider; Snider & Chao, LLP

[57] ABSTRACT

A light source device for an endoscope which sufficiently shields the high-frequency noise produced from a lamp even if there is an opening through which the lamp is exchanged. A lamp hatch for shielding the noise is provided at the opening of the lamp house, and EMI springs for maintaining the electrical conduction state are provided at the portion at which the lamp hatch and the edge portion of the opening overlap each other. When a cooling fan is provided in the lamp house, a plurality of air ports are provided in the lamp hatch which make the air flow of the cooling fan smooth and which have an effect of shielding the noise produced from the lamp. It is favorable to arrange the air ports at an interval of less than $2/\lambda$ on the assumption that the wavelength of the noise frequency is $\lambda$.

4 Claims, 6 Drawing Sheets

LIGHT SOURCE DEVICE FOR ENDOSCOPE WHICH SHIELDS LAMP NOISE

BACKGROUND OF THE INVENTION

This application claims the priority of Japanese Patent Applications No. 8-172892 filed on Jun. 12, 1996 which is incorporated herein by reference.

1. Field of the Invention

The present invention relates to a light source device for an endoscope and, more particularly, to a structure for shielding the noise produced in a light source device for an endoscope provided with a lamp house for accommodating a lamp as the light source.

2. Description of the Related Art

FIG. 8 is a side elevational view of a conventional light source device for an endoscope. A box body 2 of a light source device 1 is provided with a lamp house 4 accommodating a xenon lamp 3. A connector receptacle 5 in the front part of the light source device 1 is so composed as to receive a connector 6 of a scope and the incident 6A end of a light guide is disposed in such a manner as to face a light emitting portion of the xenon lamp 3 and the lamp house 4. The light of the xenon lamp 3 therefore is introduced to the end of the scope through the incident end 6A of the light guide and irradiates an object of observation.

The lamp house 4 is made of a metal material in the shape of a rectangular parallelopiped so as to prevent the light of the xenon lamp 3 from leaking outside and to shield the noise produced from the lamp 3. An opening 7 through which the xenon lamp 3 is exchanged is provided in the side surface of the lamp house 4. A cooling fan (not shown) is disposed on the opposite side surface of the lamp house 4 so as to cool the xenon lamp 3.

An opening 9 slightly larger than the opening 7 is provided in the box body 2 which accommodates the lamp house 4. A lamp hatch (door) 10 is attached to the opening 9 with hinges 11 so as to be rotatable. The lamp hatch 10 is opened when the xenon lamp 3 is exchanged and the xenon lamp 3 is taken out and a new one is inserted through the opening 7. The lamp hatch 10 is screwed to a supporting portion 12 provided in the opening 9 by utilizing ports 13, 14.

The opening 7 of the lamp house 4 is also utilized as an air suction hole and an air outlet hole when the xenon lamp 3 is cooled. More specifically, when the cooling fan for the xenon lamp 3 sucks air, the opening 7 serves as an air outlet hole, while the cooling fan discharges air, the opening 7 serves as an air suction hole. The air suction and air exhaustion are executed through a multiplicity of slits formed in the lamp hatch 10.

In the above-described light source device 1, however, the noise shielding effect disadvantageously is lessened due to the opening 7 provided in the lamp house 4. A high-frequency noise (e.g., noise having a frequency n times as high as 110 kHz) is produced due to the discharging operation of the xenon lamp 3, or from the wiring from the switching power source for lighting the xenon lamp 3 to the xenon lamp 3. In order to shield the noise, the xenon lamp 3 is accommodated in the lamp house 4. However, a part of the noise leaks to the outside of the lamp house 4 through the opening 7 and exerts a deleterious influence on other devices and equipments.

SUMMARY OF THE INVENTION

Accordingly, it is an object of the present invention to eliminate the above-described problems in the related art and to provide a light source device for an endoscope which is capable of sufficiently shielding a high-frequency noise produced from a lamp even when a lamp house is provided with an opening through which the lamp is exchanged.

To achieve this end, according to the present invention, there is provided a light source device for an endoscope which is capable of shielding a noise produced from a lamp, the device comprising: a lamp as a light source; a lamp house for accommodating the lamp and provided with an opening through which the lamp is exchanged; and a door provided at the opening of the lamp house for shielding a noise produced from the lamp.

It is preferable to dispose an EMI spring for maintaining the electric conduction state at the portion at which the edge of the opening and the door overlap each other.

When a cooling fan for cooling the lamp is provided, it is possible to form a plurality of air ports in the door which make the air flow of the cooling fan smooth and which have an effect of shielding the noise produced from the lamp.

It is favorable to arrange the air ports at an interval of less than $2/\lambda$ on the assumption that the wavelength of the noise frequency is $\lambda$.

According to the above-described structure, the door is attached to the opening of the lamp house while maintaining the electrical conduction, and the door is capable of shielding the noise which leaks from the opening. When it is necessary to exchange the lamp, it is possible to easily exchange the lamp by opening the door and utilizing the opening.

The air ports in the door are utilized as the air suction hole and the air outlet hole for the cooling fan, so that the cooling operation is not obstructed.

The above and other objects, features and advantages of the present invention will become clear from the following description of the preferred embodiment thereof, taken in conjunction with the accompanying drawings.

DESCRIPTION OF THE PREFERRED EMBODIMENT

Figure 4:
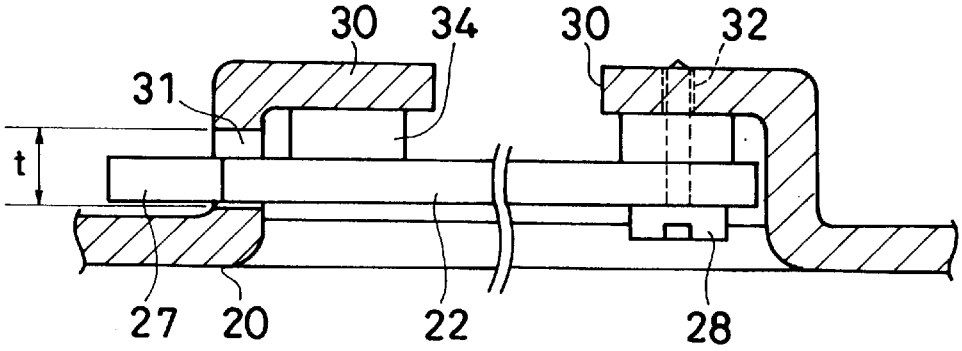
FIG. 4 is an enlarged sectional view of the hatch attaching portion shown in FIG. 3, as viewed from the upper side.
Figure 5:
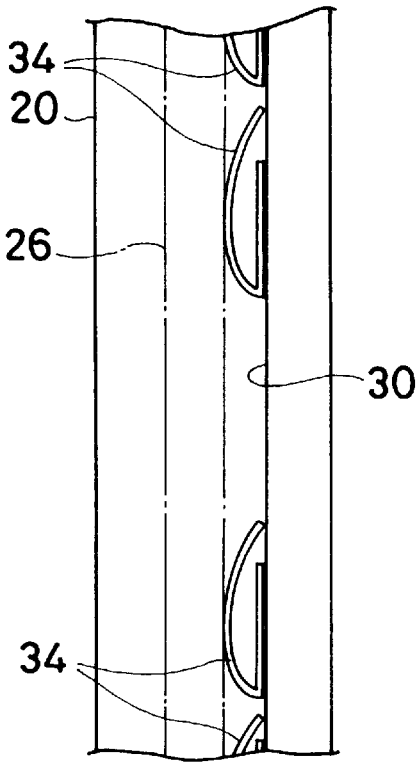
FIG. 5 is an enlarged view of one of the hatch attaching portions shown in FIG. 3, as viewed from the direction indicated by the arrow V.
Figure 6:
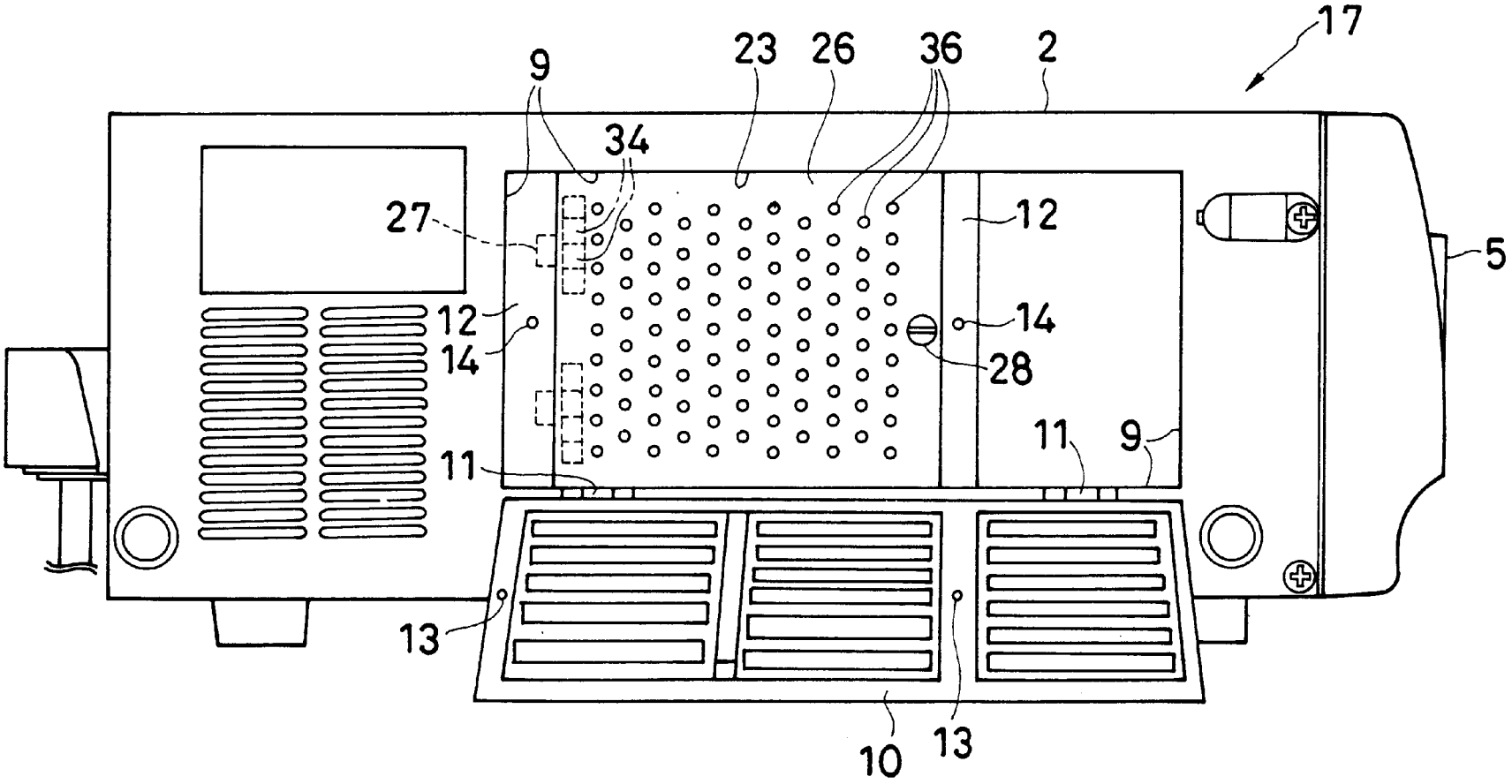
FIG. 6 is a side elevational view of the entire part of the embodiment of the light source device according to the present invention.
Figure 7:
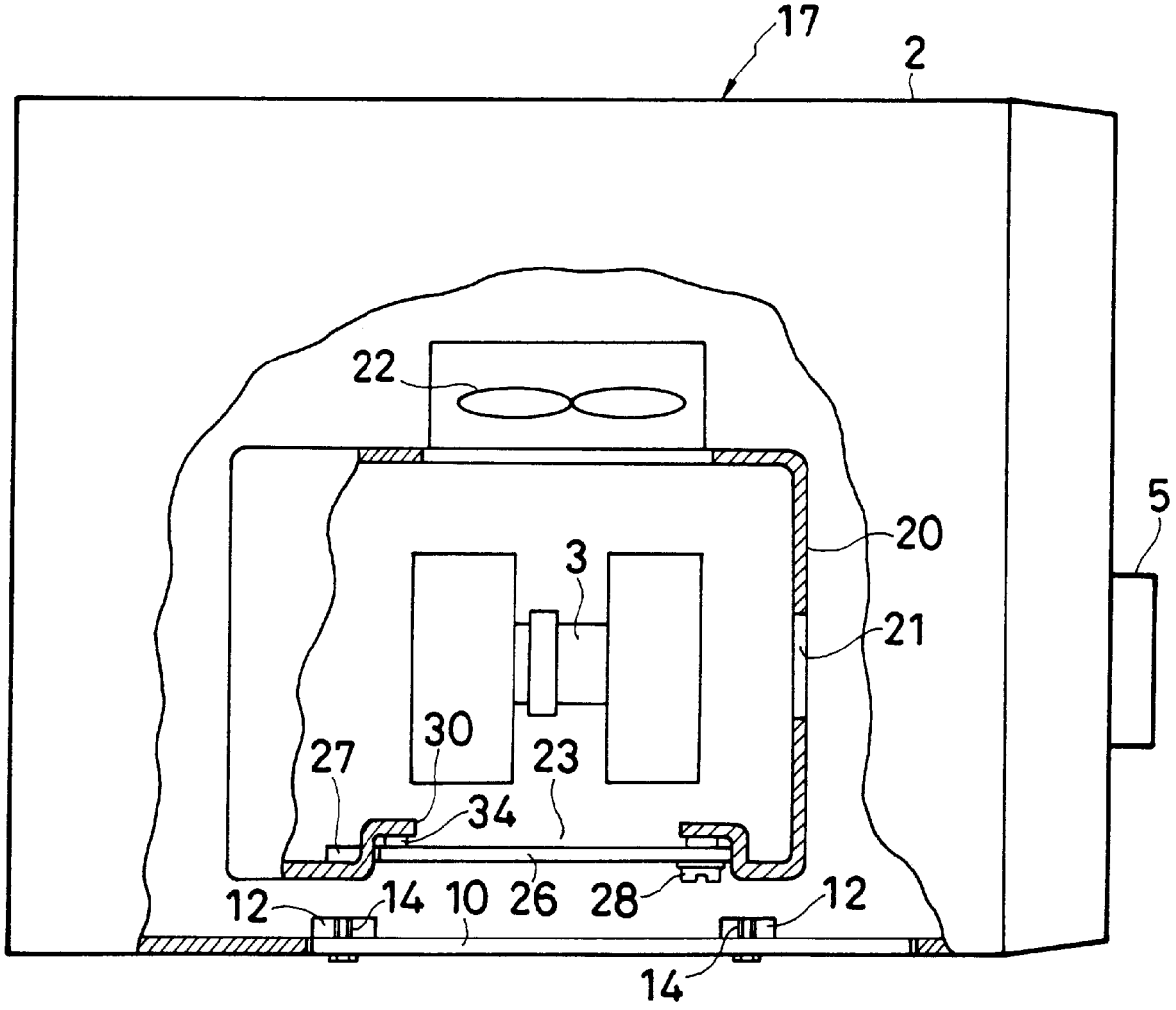
FIG. 7 is a partially sectional view of the upper surface of the light source device shown in FIG. 6.
Figure 8:
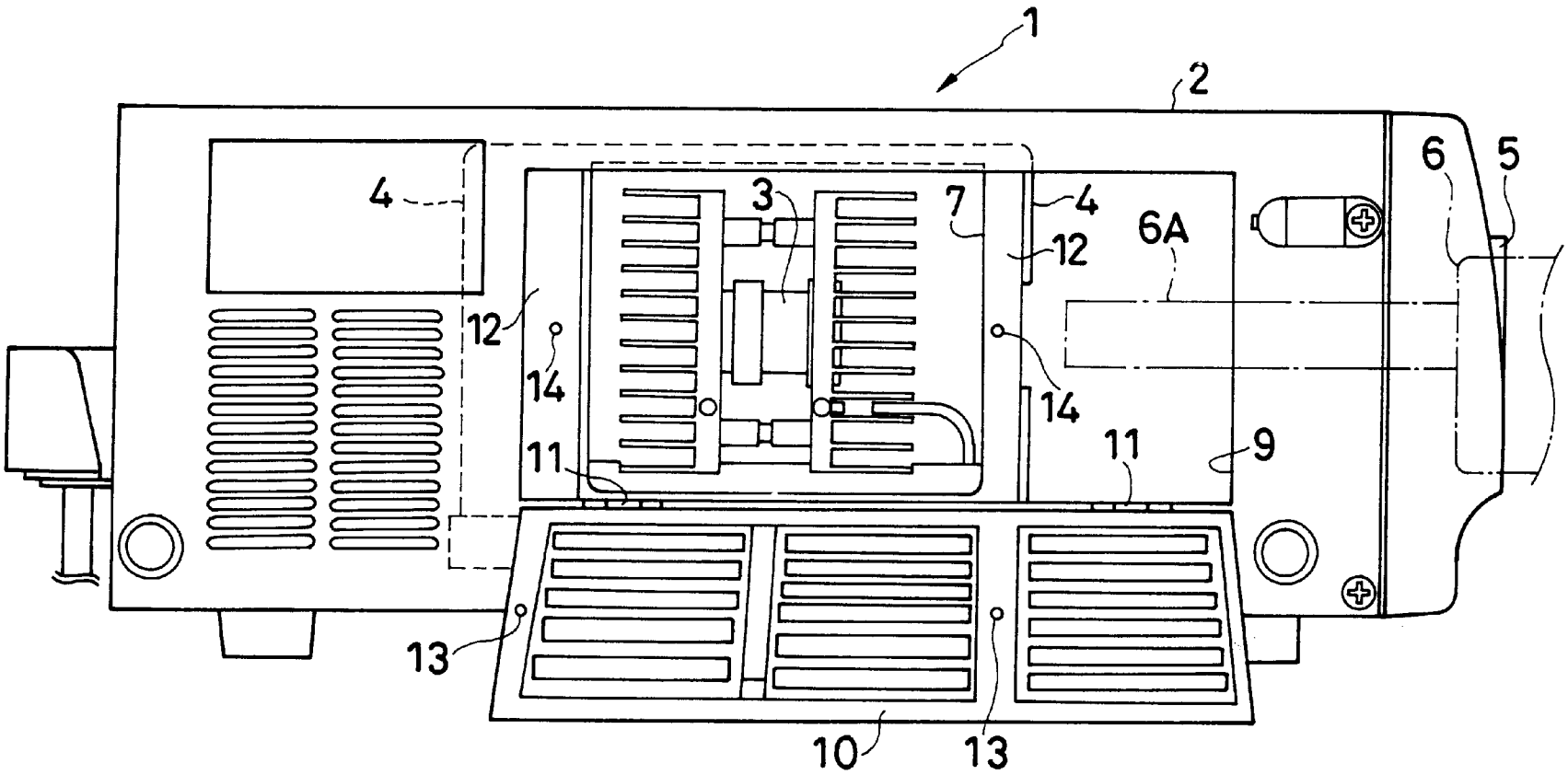
FIG. 8 PRIOR ART
FIG. 8 is a side elevational view of a conventional light source device.

FIGS. 1 to 5 are detailed views of the lamp house portion of an embodiment of a light source device for an endoscope according to the present invention, and FIGS. 6 and 7 show the entire part of the embodiment of the light source device.

The entire structure of the light source device will first be explained. In FIG. 6, a light source device 17 is provided with a connector receptacle 5 for receiving a connector of a scope and an opening 9 in the front part of a box body 2 in the same way as in a conventional light source device. A first lamp hatch 10 is attached to an edge of the opening 9 with hinges 11 so as to be rotatable. The first lamp hatch 10 is is screwed to supporting portions 12 provided at the opening 9 by utilizing ports 13, 14.

The box body 2 is provided therein with a lamp house 20 accommodating a xenon lamp 3 (another lamp will do) which serves as a light source, as shown in FIG. 7. The light of the xenon lamp 3 is emitted from a light irradiation hole 21. An opening 23 through which the xenon lamp 3 is exchanged is provided in the side surface of the lamp house 20 in such a manner as to face the first lamp hatch 10. A cooling fan 22 is disposed on the opposite side surface of the lamp house 4 so as to cool the xenon lamp 3.

Figure 1:
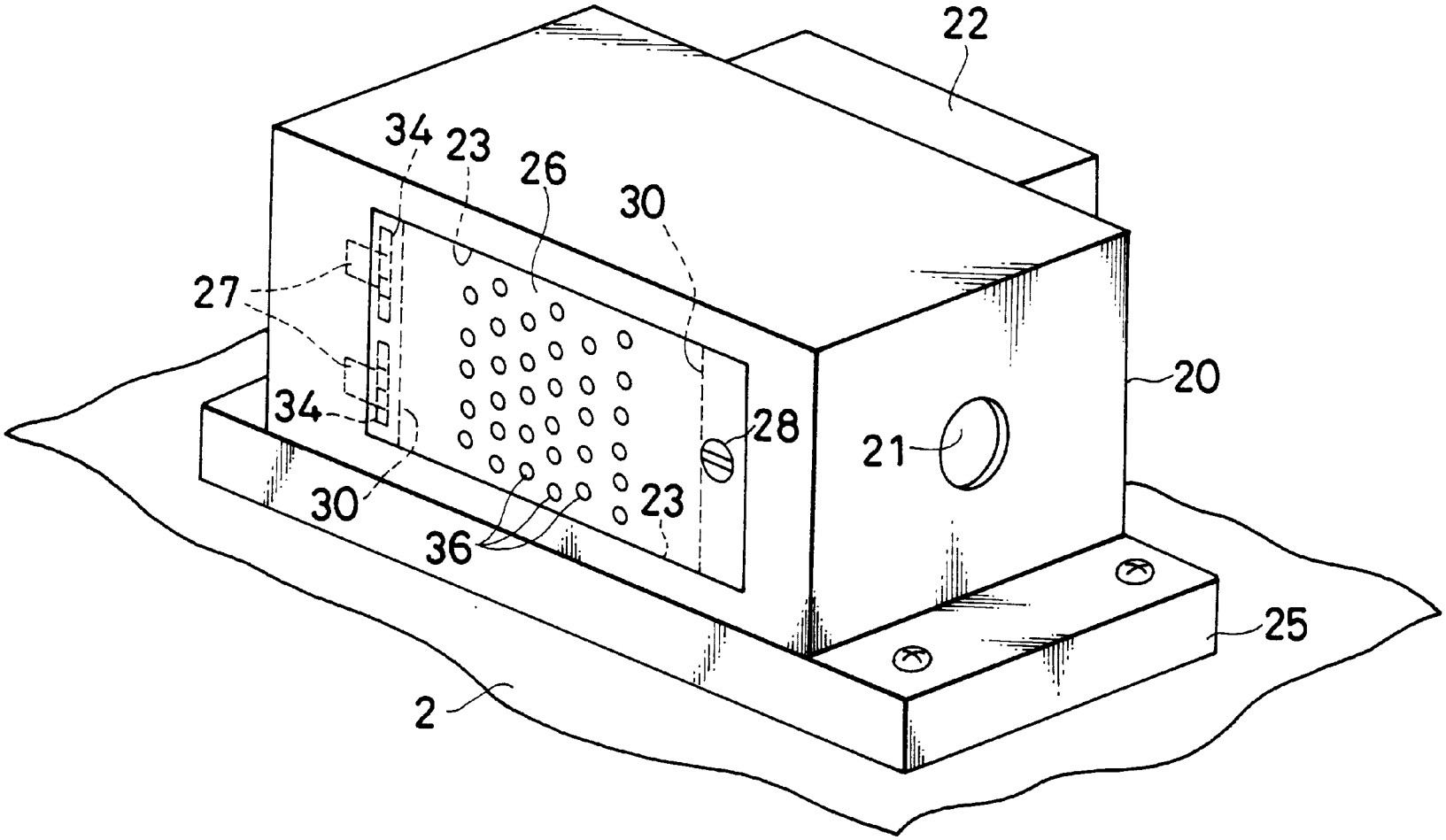
FIG. 1 is a perspective view of the lamp house of an embodiment of a light source device for an endoscope according to the present invention.

FIG. 1 is an external view of the lamp house 20. The lamp house 20 made of a rectangular parallelopiped metal material is attached to the box body 2 of the light source device 17 through an insulating plate 25 made of a resin or the like. The insulating plate 25 is disposed between the lamp house 20 and the box body 2 so as to maintain a predetermined withstand voltage (about 4 kV) so that the lamp house 20 is held in an electrically floating state. A second lamp hatch 26 is provided at the opening 23 of the lamp house 20. The detailed structure for attaching the second lamp hatch 26 is shown in FIGS. 2 to 6.

Figure 2:
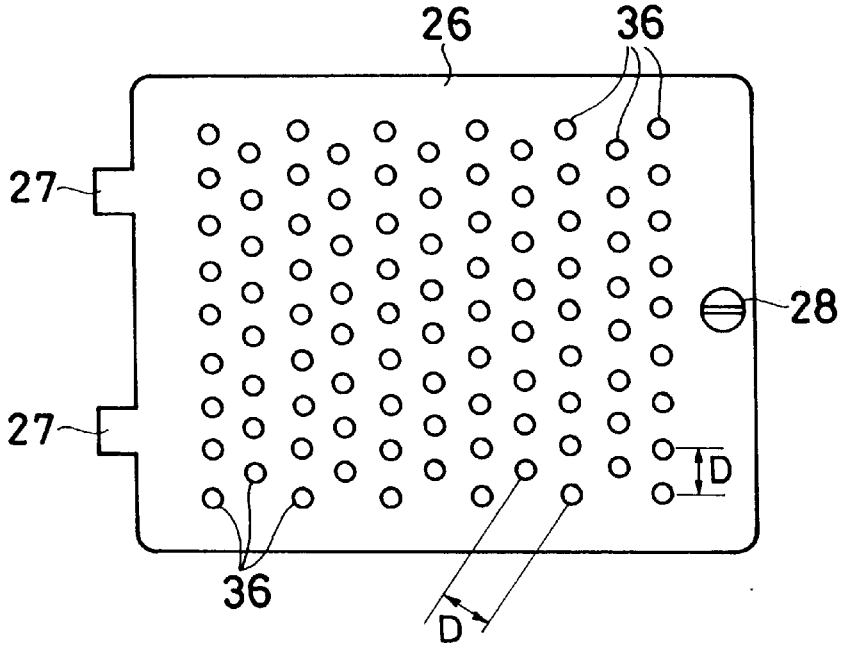
FIG. 2 shows a second hatch of the lamp house shown in FIG. 1.
Figure 3:
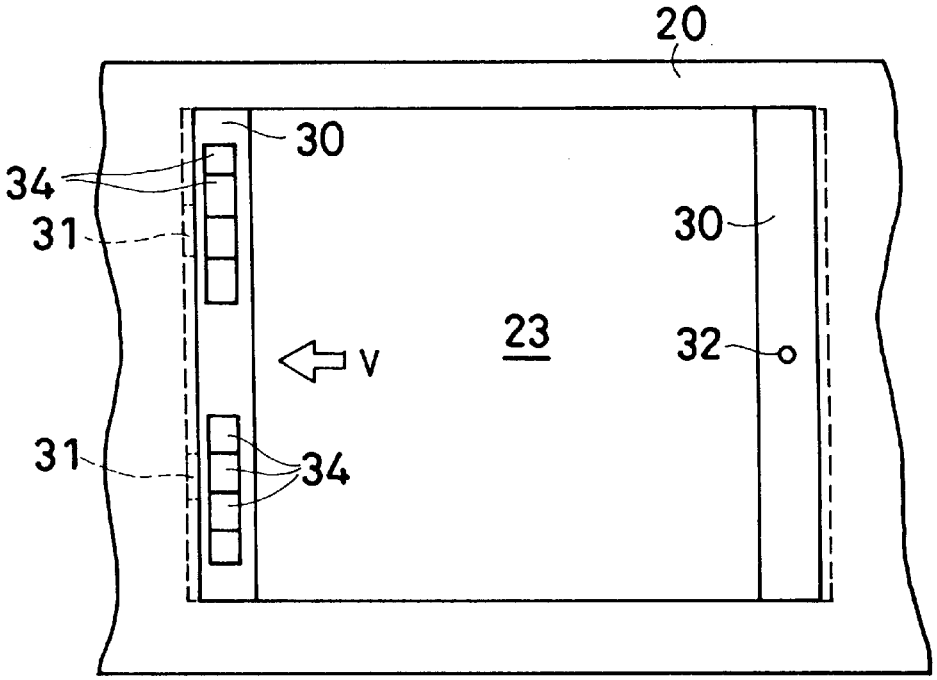
FIG. 3 shows the hatch attaching portions of the lamp house shown in FIG. 1.

FIG. 2 shows the second lamp hatch 26. Two projection pieces 27 are provided on the left side of the second lamp hatch 26 and a fixing screw 28 is disposed on the right side of the second lamp hatch 26. FIG. 3 shows the opening 23. Hatch attaching portions 30 are provided at the ends of both sides of the opening 23. The hatch attaching portions 30 are made of the side plate of the box body 20 which is bent inward so as to be set back, as shown in FIG. 4 (the portion in which the opening 23 is provided is horizontally cut viewed from the upper side), and insertion holes 31 into which the projection pieces 27 of the second lamp hatch 26 are inserted are formed in the left hatch attaching portion 30. The width t of the insertion hole 31 in the vertical direction is set to a size which allows the projection piece 27 to advance and withdraw to a certain extent in the horizontal direction.

A tapped hole 32 for fixing the fixing screw 28 via a spacer or the like is provided in the right hatch attaching portion 30. The second lamp hatch 26 is attached to the lamp house 20 by inserting the projection pieces 27 into the insertion holes 31 and fixing the fixing screw 28. Thus, the opening 23 is covered. Alternatively, the second lamp hatch 26 may be attached to the lamp house 20 by a hinge structure.

In this embodiment, a plurality of EMI (electro-magnetic interference) springs 34 are arranged so as to maintain the electric conduction state between the second lamp hatch 26 and the lamp house 20 when they are attached to each other. The EMI spring 34 is a conductive spring member composed of a bottom surface portion and an arch portion which rises from the bottom portion in the form of an arch, as shown in FIG. 5. A conductive pasting member is provided on the bottom portion. In this embodiment, the EMI spring 34 is pasted to the surface of the left hatch attaching portion 30 by the pasting member, as shown in FIG. 3. It is naturally possible to arrange the EMI springs on the right hatch attaching portion 30 or the like.

Owing to the EMI springs 34, the second lamp hatch 26 is disposed in a state in which it is pressed and deformed, as shown in FIGS. 4 and 5, so that the second lamp hatch 26 and the lamp house 20 safely come into electrical contact with each other.

According to the above-described structure for attaching the second lamp hatch 26 to the lamp house 20, the connecting mechanism of the projection piece 27 and the insertion hole 31 facilitates a good arrangement of the EMI springs 34. In other words, if the second lamp hatch 26 is attached to the lamp house 26 by a hinge structure, it is complicated to set the interval between the hatch attaching portion 30 (on which the EMI spring 34 is pasted) and the second lamp hatch 26 because it depends on the urging force of the EMI spring 34, and if there is an error in setting the interval, it is impossible to maintain a good contact state. On the other hand, according to the structure of the embodiment, since the projection piece 27 can move in the insertion hole 31 to a certain extent, the positioning which maintains a good contact state is possible in accordance with the urging force of the EMI spring 34, and the setting of the interval between the hatch attaching portion 30 and the second lamp hatch which is essential in the hinge structure is unnecessary.

Furthermore, a plurality of air ports 36 for sucking and discharging air into and from the lamp house 20 are formed in the second lamp hatch 26, as shown in FIG. 2, and, for example, when air is discharged from the cooling fan 22, the air ports 36 serve as air suction holes. The air ports are arranged at an interval D of less than $2/\lambda$ ($\lambda$=the wavelength of the frequency of the noise) so as to safely shield the noise produced from the xenon lamp 3. For example, when the noise having a frequency of 300 MHz ($\lambda \approx 100$ cm) is attenuated by 20 dB, the interval D is set at about 5 cm. (The shield effect E is represented by $E=20 \log (\lambda/2D)$. Thus, it is possible to maintain the noise shielding effect.

According to the above-described structure, it is possible to shield the noise which is produced from the xenon lamp 3 and leaks through the opening 23 by providing the second lamp hatch 26 in the lamp house 20. By providing the air ports 36 in the second lamp hatch 26, it is possible to sufficiently cool the xenon lamp 3 by the cooling fan 22.

Furthermore, when the xenon lamp 3 is exchanged, it is easy to take out the xenon lamp 3 and insert a new one through the opening 23 by taking out the second lamp hatch 26 by removing the fixing screw 28.

As explained above, according to the present invention, even if there is an opening through which a lamp is exchanged, it is possible to sufficiently shield the high-frequency noise produced from the lamp. In addition, when a cooling fan is provided, a good cooling operation is enabled by providing a plurality of air ports which maintain the noise shielding effect.

While there has been described what is at present considered to be a preferred embodiment of the invention, it will be understood that various modifications may be made thereto, and it is intended that the appended claims cover all such modifications as fall within the true spirit and scope of the invention.

What is claimed is:

1. A light source device for an endoscope comprising:

a lamp as a light source a lamp house which is made of an electrically conductive material for accommodating the lamp and provided with an opening through which said lamp is exchanged;

a door which is made of an electrically conductive material provided at said opening of said lamp house for shielding a noise produced from said lamp; and an electric conduction means for maintaining an electric conduction state which is disposed at a portion at which an edge of said opening an edge of said door overlap each other.

2. A light source device for an endoscope according to claim 1, wherein said electric conduction means is an EMI spring.

3. A light source device for an endoscope comprising:

a lamp as a light source a lamp house which is made of an electrically conductive material for accommodating the lamp and provided with an opening through which said lamp is exchanged;

a door which is made of an electrically conductive material provided at said opening of said lamp house for shielding a noise produced from said lamp;

an electric conduction means for maintaining an electric conduction state which is disposed at a portion at which an edge of said opening an edge of said door overlap each other;

a cooling fan for cooling said lamp; and a plurality of air ports provided in said door which make the air flow of said cooling fan smooth and which have an effect of shielding the noise produced from said lamp.

4. A light source device for an endoscope according to claim 3, wherein said air ports are arranged at an interval of less than $2/\lambda$ on the assumption that the wave length of the frequency of said noise is $\lambda$.

* * * * *